US007090562B1

(12) United States Patent
Boyd et al.

(10) Patent No.: US 7,090,562 B1
(45) Date of Patent: Aug. 15, 2006

(54) METHODS OF AND APPARATUS FOR PRE-PLANARIZING A SUBSTRATE

(75) Inventors: John M. Boyd, Atascadero, CA (US); Fred C. Redeker, Fremont, CA (US); Yezdi Dordi, Palo Alto, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 11/217,910

(22) Filed: Aug. 31, 2005

(51) Int. Cl.
*B24D 17/00* (2006.01)

(52) U.S. Cl. ..... 451/8; 451/177; 451/506

(58) Field of Classification Search ..... 451/504, 451/506, 8, 177, 526, 539
See application file for complete search history.

(56) References Cited

U.S. PATENT DOCUMENTS 2,938,309 A * 5/1960 Pollet ..... 451/506
3,735,535 A * 5/1973 Waller ..... 451/506
3,905,080 A * 9/1975 Bond ..... 29/76.1
6,254,467 B1 * 7/2001 Prosl ..... 451/465

* cited by examiner

*Primary Examiner*—Jacob K. Ackun, Jr.
(74) *Attorney, Agent, or Firm*—Martine Penilla & Gencarella, LLP

(57) ABSTRACT

Methods and apparatus are provided to provide a substantially uniform layer thickness above a wafer contour as the wafer rotates and is traversed past a pre-planarization tool. The tool has a shank defining an axis of rotation, and a planarization member coupled to the shank has a hook-shaped section supporting a pre-planarization surface spaced by an at-rest-distance from the axis of during an at-rest condition of the shank. The hook-shaped section has a modulus of elasticity selected so that upon rotation, the hook-shaped section flexes and moves the pre-planarization surface to rotation-distances spaced from the axis in response to a velocity of rotation of the hook-shaped section around the axis in a range of velocities. As the tool rotates, metrology intermittently directly senses the layer thickness and controls the velocity of rotation so the rotation-distances have values in excess of a value of the at-rest-distance.

11 Claims, 12 Drawing Sheets

METHODS OF AND APPARATUS FOR PRE-PLANARIZING A SUBSTRATE

BACKGROUND OF THE INVENTION

1. Field of the Invention

The present invention relates generally to semiconductor manufacturing and, more particularly, to methods of and apparatus for pre-planarizing a substrate in order to more efficiently perform a planarization operation.

2. Description of the Related Art

During copper interconnect manufacturing, a copper layer is deposited on a seed/barrier layer using an electroplating process. Components in the electroplating solution provide for appropriate gap fill on sub-micron features. However, these sub-micron features tend to plate faster than bulk areas and larger, i.e., greater than 1 μm, trench regions. Regions of the sub-micron features are typically found in large memory arrays such as, for example, static random access memory (SRAM). These array regions can comprise large areas of the wafer. The topography resulting from the electroplating process may be referred to as the "copper topography", and is not suitable to receive further layers without being planarized. Also, it should be appreciated that such large-area array regions have additional copper topography that must be planarized in addition to required planarization of the larger trench regions.

FIG. 1 is a simplified schematic diagram illustrating a silicon substrate 100 having a copper layer 102 deposited thereon. Copper layer 102 is deposited on a seed/barrier layer 104 disposed over the silicon wafer 100 using an electroplating process. As mentioned above, components in the electroplating solution provide for good gap fill on submicron features, such as sub-micron trenches in regions 104*a* and 104*b*, but these features tend to plate faster than the bulk areas and trench regions 106*a*–d. The faster plating results in undesirable "steps" in the copper topography on the substrate, illustrated by regions 108*a* and 108*b*, over the sub-micron trench regions. Thus, these large area regions (e.g., 108*a*), which step up in height, must be planarized along with the copper topography over the trench regions 106*a*–d. Exacerbating this situation is that the silicon wafer 100 itself has an inherent waviness (nanotopography) introduced during the silicon wafer manufacturing process (e.g., using wire saw, lapping, polishing). Because of the waviness, the surface of the silicon wafer that receives the seed/barrier layer 102 (and which underlies the layer 104 and the copper layer 102) is not perfectly flat. The wafer is said to have a "wavy topography", or "contour", and this contour may extend across the entire wafer surface. FIG. 1 shows a peak 109P and a valley 109V of such contour.

Current planarization techniques are not suited to properly planarize such copper topography resulting from the electroplating process. For example, such planarization techniques are sensitive to pattern density and circuit layout. More specifically, chemical mechanical planarization (CMP) processes must be "tuned" based on upon properties of the incoming wafer properties to be processed. By this tuning, changes are made to the CMP process, such as changing consumables (pad and slurry) in order to accommodate variations within lots (or batches) of the incoming wafers. Such changes also are made to accommodate different pattern densities and circuit layouts on incoming wafers that are typical of mixed-product manufacturing lines. When attempting to perform a single CMP process on such copper topography without changing the consumables, attempts to completely remove the copper from regions

108*a* and 108*b* result in excessive dishing and erosion over trench regions 106*a*–d. Additionally, not only must the CMP process remove the excess copper in regions 108*a* and 108*b*, but the CMP process must also perform this removal in a manner that follows the contour of the substrate. Current CMP processes do not suitably deal with both of these variables.

Another limitation of current CMP processes and related equipment is that the spindle that carries the wafer for processing is not designed for accurate Z axis motion. Instead, the substrate is pressed against the polish pad and the pad is engineered with a hardness that allows it to follow the contours of the wafer. This allows short-to-medium range planarization distances (0.16–200 um), but not long-range planarization distances (1–5 mm).

Further, the effectiveness of existing metrology used to control such current CMP processing is limited to average measurements that extrapolate a measurement site to other sites that are not measured. The accuracy of the extrapolation may be reduced by structure and consumables used with current CMP processing equipment. These include, for example, endless belts that engage the wafer and interfere with viewing or other monitoring of the planarizing activity by metrology apparatus. Also, many CMP slurries are thick and not optically clear, for example, which tends to further interfere with viewing or other monitoring of the planarizing activity by the metrology apparatus.

As compared to such CMP processing, known wafer grinding equipment has accurate Z axis control. However, in the past the object of such wafer grinding equipment has been to produce an absolutely flat wafer surface. By definition, such wafer grinding equipment does not follow the wafer contour, because that contour is to be eliminated in producing the absolutely flat wafer surface. Further, because the sensitivity (or resolution) required for following the wafer contour is in the submicron range of Z motion, stepping motors, for example, may possibly be inadequate for providing Z axis motion in submicron increments. In any event, such motors, x-y stages and substrate chucks are relatively costly.

Despite these disadvantages of wafer grinding techniques, efforts relating to development of embodiments of the present invention have included attempts to apply wafer grinding techniques to wafers having a copper topography, as defined above. In one such approach, a horizontal grinding ring is provided with segmented compliant layers. The ring has a large diameter (e.g., of 12–14 inches) and thus extends across a large area of the wafer (e.g., 8–12 inches, depending on the substrate diameter) during grinding. Each segmented layer is provided with abrasive materials that are pressed into contact with the copper topography of the wafer to scratch the copper topography. These attempts to apply wafer grinding techniques to wafers having the copper topography have advantages of higher average removal rates, for example. However, simplification of the horizontal grinding ring for such purposes as cost-reduction and increasing ability to provide Z height control in the submicron range, remain as objectives. Also, it would be desirable to provide further simplification to reduce interference with real-time in-situ viewing or other monitoring of the grinding activity by metrology apparatus.

In view of the foregoing, there is a need for methods of and apparatus for normalizing the surface of a substrate to be planarized in order to more efficiently perform planarization processes. Such need includes removing the excess copper in regions 108*a* and 108*b* while following the wavy contour of the substrate, which would normalize the wafer surface to provide a uniform thickness of the copper film regardless of height changes of the wavy contour of the wafer surface or the initial topography of the copper film. Such need further includes normalizing that is independent of other properties of the incoming wafer properties to be processed, e.g., pattern density and circuit layout, such that there can be minimal or reduced changes in the consumables or process parameters used for CMP processing after normalizing. Such need additionally requires providing a relatively low-cost way to provide highly accurate (in a nanometer range) Z motion of a tool relative to a surface of a wafer. Such need further includes performing normalizing without interfering with viewing or other monitoring of the normalizing activity by metrology apparatus.

SUMMARY OF THE INVENTION

Broadly speaking, embodiments of the present invention fill these needs by providing methods of and apparatus for normalizing the surface of a substrate using a pre-planarization process. Several inventive embodiments of the present invention are described below.

In one embodiment a tool for pre-planarizing a wafer is provided. The tool may have a shank defining an axis of rotation. A planarization member is coupled to the shank, and may include a planarization surface spaced at an at-rest-distance from the axis of rotation during an at-rest orientation of the shank. The planarization member is configured so that during a rotational orientation of the shank around the axis of rotation, the planarization member rotates around the axis of rotation and spaces the planarization surface at a second-distance from the axis of rotation. A value of the second distance is greater than the at-rest-distance.

Another embodiment of the tool for pre-planarizing a wafer is provided. The tool may be a grinding tool having the shank defining an axis of rotation, and the planarization member is coupled to the shank. The planarization member may be configured with a hook-shaped section and a pre-planarization grinding surface mounted on the hook-shaped section and spaced by an at-rest-distance from the axis of rotation during an at-rest condition of the shank. The hook-shaped section is configured with a modulus of elasticity selected so that upon rotation of the planarization member around the axis of rotation the hook-shaped section flexes and moves the pre-planarization grinding surface to a plurality of rotation-distances from the axis of rotation in response to velocities of rotation of the hook-shaped section around the axis of rotation in a range of velocities. The rotation-distances from the axis of rotation have a value in excess of a value of the at-rest-distance.

In another embodiment, a system for pre-planarizing a wafer is provided. The system may include a shank defining an axis of rotation. A drive rotates the shank with the axis of rotation spaced from the wafer. A planarization member rotated by the rotating shank around the axis of rotation is configured with a planarization section offset from the axis. The section has a modulus of elasticity selected so that during the rotation the planarization section deflects in response to centripetal force, the deflection being at a value in proportion to the velocity of rotation of the planarization section around the axis of rotation. The value is a value at which the planarization section may contact the wafer that is spaced from the axis of rotation. The drive rotates the shank with the axis of rotation spaced from and within a range of angles with respect to a surface of the wafer to be pre-planarized, the range of angles being from about zero degrees to about 45 degrees.

In another embodiment, the system may operate with the wafer having a wavy topography characterized by a contour from which a layer extends, the layer having an irregular thickness relative to the contour. The system may include a mount for rotating and traversing the wafer relative to the tool so that as the wafer rotates and traverses the planarization section contacts successive locations of the contoured topography of the wafer. The velocity of rotation of the planarization section around the axis of rotation is used to control the deflection of the planarization section within a predetermined range of values so that the planarization section follows the contour and removes portions of the layer to provide a pre-planarized substantially uniform layer thickness above the contour.

In another embodiment, a method of pre-planarizing a wafer is provided. The method may provide an operation of configuring a planarization tool with a shank defining an axis of rotation. The axis of rotation is spaced from the wafer by a first radial space having a first value. A planarization member is configured with a section coupled to the shank for rotation around the axis of rotation and located at an at-rest-position spaced by an at-rest-distance radially from the axis of rotation. The at-rest-distance has a second value that is less that the first value. The configuring of the section provides a flexure characteristic by which the planarization member responds to forces resulting from the radial spacing during the rotation, such that during the rotation the section flexes and the planarization member becomes located at a rotation-position spaced at a rotation-distance radially from the axis of rotation. A value of the rotation-distance is greater than the values of the at-rest-distance and the first value. The flexure characteristic is proportional to a velocity at which the planarization member rotates around the axis of rotation. The method may also control the velocity at which the planarization member rotates around the axis of rotation to selectively position the planarization member within the space between the tool and the wafer so that the planarization surface engages the wafer to perform a pre-planarization operation on the wafer.

In another embodiment the method may include further configuring of the planarization member to provide the flexure characteristic as a modulus of elasticity whereby changes in the velocity of rotation result in changes in the flexure. Also, the wafer may have a wavy topography characterized by a contour from which a layer extends, the layer initially having an irregular thickness relative to the contour. The wafer is rotated and traversed relative to the tool so that as the wafer rotates and traverses the planarization surface contacts successive locations of the copper topography of the wafer. During the rotation of the section around the axis of rotation the section periodically contacts the layer so that during a non-contact, or clear view, time period in which the rotating section is away from the wafer and exposes the layer. During that period of time, monitoring of the pre-planarization of the wafer may be performed to determine the thickness of the layer at an exposed location of the layer last contacted by the section.

Other aspects and advantages of the invention will become apparent from the following detailed description, taken in conjunction with the accompanying drawings, illustrating by way of example the principles of embodiments of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE PREFERRED EMBODIMENTS

An invention is described for apparatus, methods, and a system for producing a normalized surface in preparation for a chemical mechanical planarization (CMP) process. It will be obvious, however, to one skilled in the art, that embodiments of the present invention may be practiced without some or all of these specific details. In other instances, well known process operations have not been described in detail in order not to obscure the present invention.

The embodiments of the present invention provide an apparatus, method, and system for performing a pre-planarization process in order to normalize a surface to be planarized. This normalization enables standardization of a subsequent planarization process. With this standardization, a number of benefits such as predictability, cost savings, etc., are realized. In one embodiment, the pre-planarization process is a process which scratches the top surface, e.g., a copper layer, of a copper topography of the substrate. As used herein, the terms substrate and wafer are interchangeable.

The described pre-planarization of these embodiments may be appreciated by reference to a planarization length, which refers to the relative distance of low regions between associated features. For example, associated features may include dense array areas, such as characterizes interconnects of memory modules (such as SRAM blocks). In the dense-array arrays, the top surface of "superfill" copper above the array area is of a level higher than the copper overburden above a field region, which is another feature. Regions of the dense-array areas generally can comprise only a few large blocks of area in a die, and thus have a planarization length somewhere in the order of the die size (about 1–15 millimeters (mm)), which represents one planarization length.

Another example is the larger trench regions, in which the top surface of the copper inside the trench region has a level lower than the copper overburden above the field region. The larger trench regions have a micron (μ) scale and frequency, in that the planarization length of the larger trench regions on the substrate is typically less than a few hundred microns, which represents another planarization length. Additionally, these larger trench regions are generally uniformly distributed across the die and can be more easily be managed using conventional CMP processing techniques and consumables given a typical planarization length of less than 100 um.

Thus, the larger trench regions are associated with a micron (μ) scale and frequency, while the dense-array regions are associated with a millimeter scale and frequency. Notwithstanding these significant differences in the scale of the planarization lengths of the features to be pre-planarized, and in such frequency, in the embodiments the pre-planarization process is performed without regard to the magnitude of these differences.

Figure 2A:
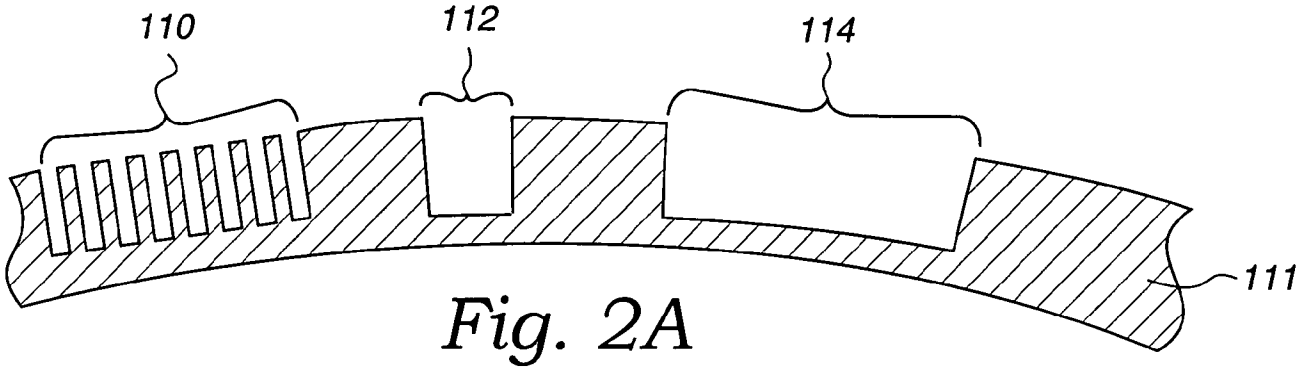
FIGS. 2A through 2D are schematic diagrams illustrating the topography associated with an electroplating copper process and the resulting inefficiencies caused when attempts are made to planarize this topography without the pre-planarization by embodiments of the present invention.
Figure 2B:
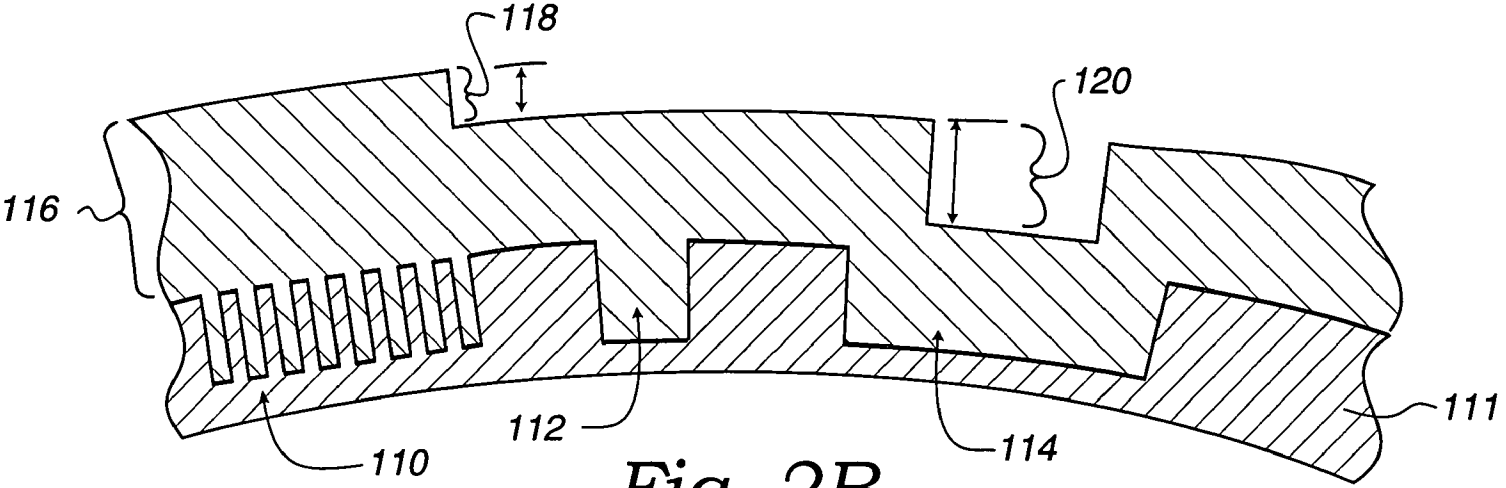
Figure 2C:
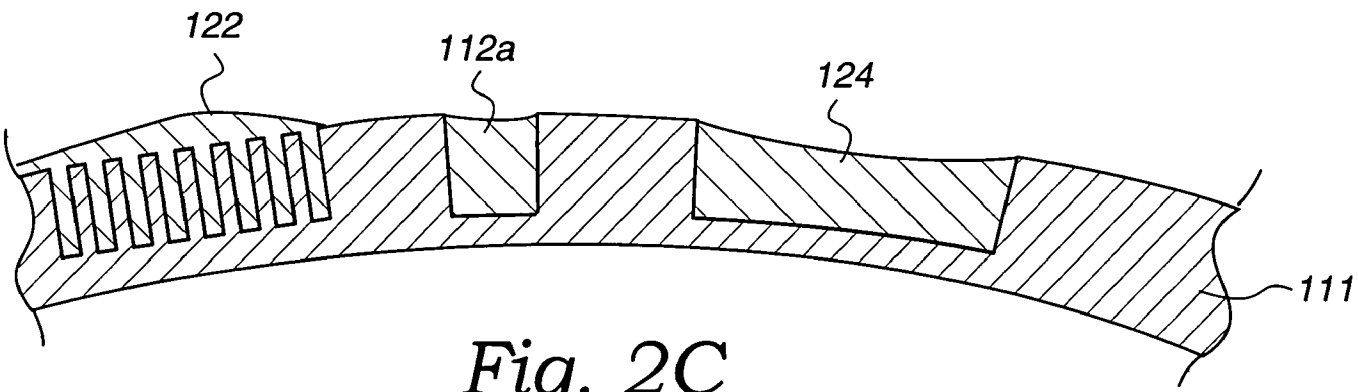
Figure 2D:
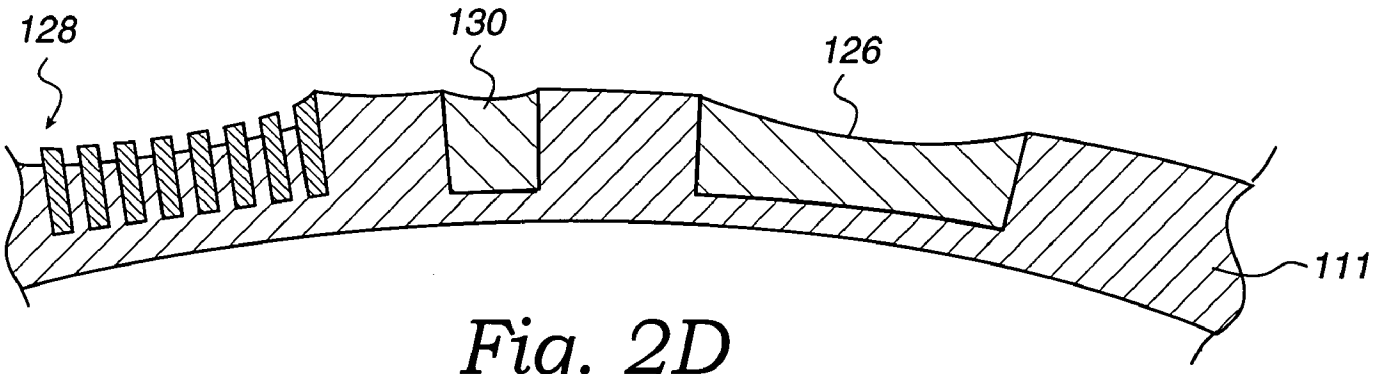

FIGS. 2A through 2D are schematic diagrams illustrating the topography associated with an exemplary electroplating copper process and the resulting inefficiencies caused when attempts are made to planarize this copper topography without the pre-planarization by embodiments of the present invention. In FIG. 2A, substrate 111 includes a region of sub-micron trenches 110 defined therein. In addition, larger trenches 112 and 114 are defined within substrate 111. FIG. 2B illustrates the results of a copper electroplating process. Here, super-fill 116 above the sub-micron trenches 110 is created and has a step up in height as compared to the overburden above the field regions of the substrate. In one embodiment, the step up in height illustrated by distance 118 is approximately 0.15 to 2.0 microns. As can be seen, a trench region having a depth 120 is defined above large trench 114, which was filled with copper during the electroplating process. FIG. 2C illustrates the results of a CMP process in which an endpoint is based on the planarization process applied to filled smaller trench 112*a*. As illustrated, while filled trench 112*a* has been planarized, the adjacent super-fill region 122 retains an excessive amount of copper (referred to as a "puddle" of copper). At the same time, larger trench 114 experiences dishing and erosion effects as illustrated by surface 124. FIG. 2D illustrates the results of an overpolish applied to substrate 111 in order to clear the copper puddle (i.e., the excess copper over the sub-micron trenches, i.e., array region. It should be appreciated that the overpolishing has caused each of the trench features of FIG. 2D to experience dishing/erosion as a result of current CMP processes, as shown by surfaces 126, 128, and 130.

Figure 3A:
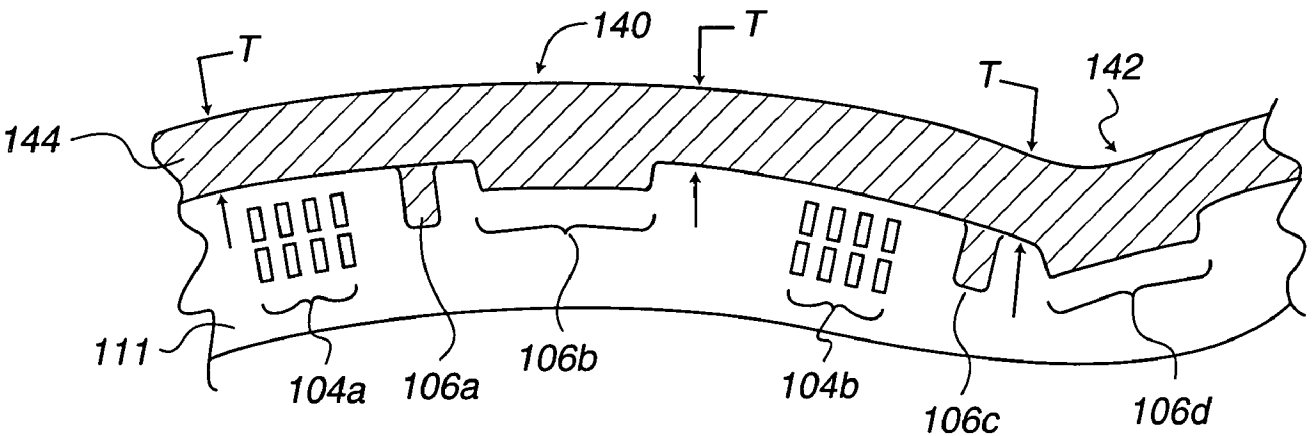
FIG. 3A is a pictorial representation of a cross section of a substrate surface after the completion of a pre-planarization process according to embodiments of the present invention.
Figure 3B:
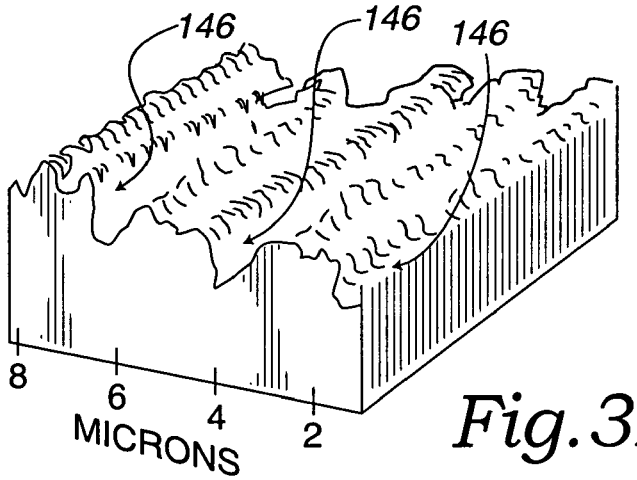
FIG. 3B is a representation of an atomic force microscopy (AFM) analysis of the substrate surface of FIG. 3A showing scratches made during the pre-planarization process according to embodiments of the present invention.

FIG. 3A is a pictorial representation of a cross section of a substrate surface after the completion of a pre-planarization process according to embodiments of the present invention. A portion of the contour of the substrate is shown as including a peak 140 and a valley 142. A copper layer 144 is shown having a uniform thickness (generally in a Z direction) above the contour. FIG. 3B is a pictorial representation of an atomic force microscopy (AFM) analysis of this substrate surface after the completion of the pre-planarization process according to embodiments of the present invention. As can be seen, this pre-planarization processing is depicted as resulting in a number of scratches (microtopography) 146 across the pre-planarized surface of the substrate. According to this representation of the AFM analysis, the scratches have a depth of approximately 0.2 microns and a width of approximately 2 microns. It should be appreciated that this type of topography configuration is optimal for a so-called short-range planarization technique that will follow the present pre-planarization technique that introduced these scratches. In essence, the pre-planarization creates a new pattern that is independent of the incoming copper topography, i.e., the scratched surfaces of the wafers appear the same regardless of the pattern layout, product type, copper film thickness, as the wafers exit the pre-planarization process. Furthermore, the scratches 146 depicted in FIG. 3B may be thought of as small trenches which such short range planarization process is optimized to remove. Of course, the depth of the scratches 146 is less than the thickness of the copper layer in order to assure that enough copper remains to allow the subsequent planarization of the scratched surface produced during the pre-planarization step. Similarly, consistent with FIG. 3A, this pre-planarized scratched surface of the substrate has the contour of the wafer that was present before pre-planarization.

Benefits of embodiments of the present invention may also be appreciated by reference to abrasive-free slurries, such as that produced by Hitachi, which are formulated to remove copper and planarize the substrate. These slurries are highly selective due to a chemical change produced when a tantalum barrier is exposed during endpoint, thereby forming a galvanic couple between the copper and the tantalum barrier, and resulting in inhibition of the copper polish process. Thus, the process may be referred to as self-stopping. The abrasive-free slurries have demonstrated superior dishing and erosion characteristics. Previous to the embodiments of the present invention, the puddles of copper remaining in the array regions stopped the CMP removal process before all the copper was cleared. Thus, previous to the embodiments of the present invention, the abrasive-free slurries were rendered useless for many die layouts that have a moderate to high super-fill region thickness, such as the areas in SRAM regions. In contrast, as illustrated by FIGS. 3A and 3B, after such pre-planarization, the scratched substrate surface is free from the superfill regions of copper in the array regions, and may be further processed using the above-referenced abrasive-free slurries which are formulated to remove copper and planarize the substrate.

Figure 4:
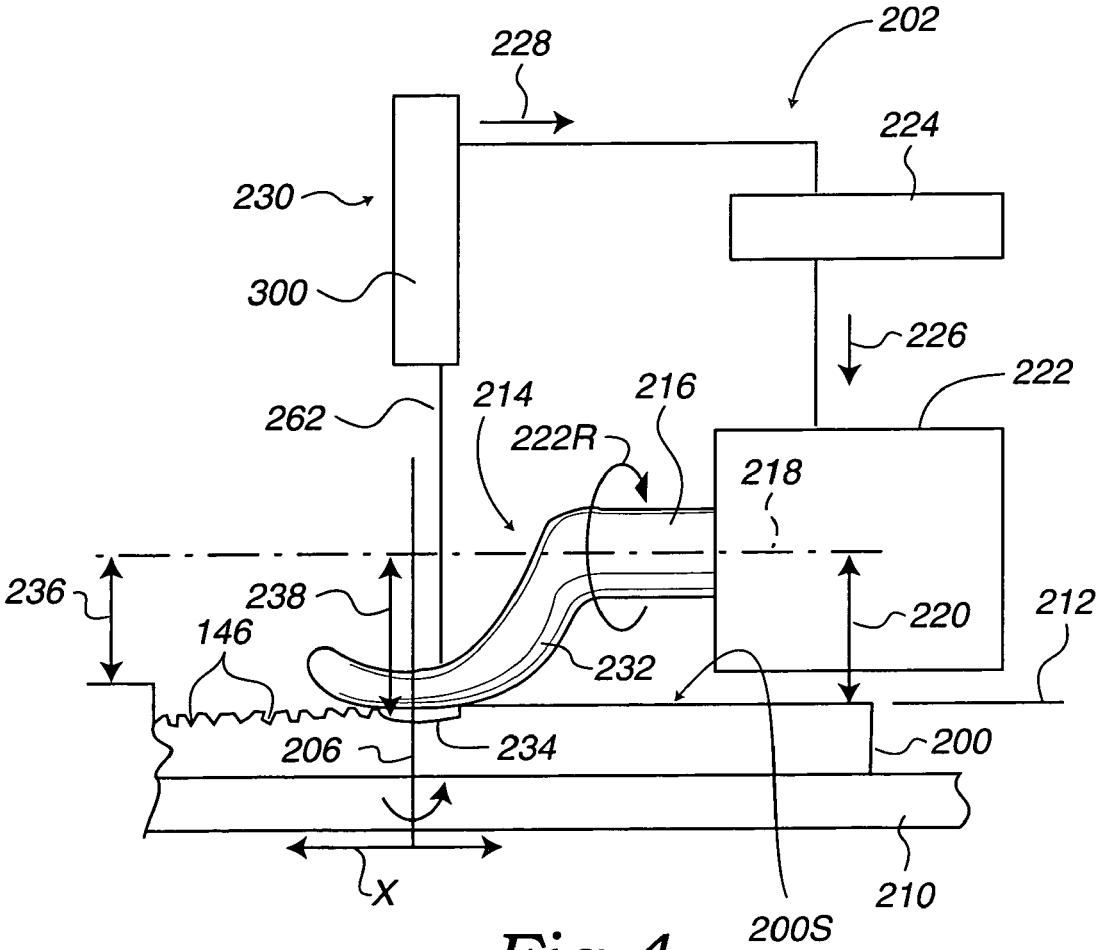
FIG. 4 is a schematic illustration of an embodiment of the present invention for pre-planarizing a substrate in order to more efficiently perform a planarization operation in accordance with one embodiment of the invention.

FIG. 4 is a schematic illustration of an embodiment of the present invention for pre-planarizing a substrate in order to more efficiently perform a planarization operation. A substrate 200 is shown in position in a system 202 ready to be pre-planarized. For example, the substrate 200 may be as shown in and described with respect to FIGS. 2A and 2B above, which is an initial configuration of the wafer 200 before pre-planarization. The wavy contour of the substrate with the irregular exemplary copper layer on the contour may be described as defining an upper surface 200S of the copper topography which is to be pre-planarized. In the initial configuration shown in FIG. 2B, the layer has the irregular (e.g., stepped), or non-uniform, thickness T above the contour of the substrate. In reference again to FIGS. 3A and 3B, the objective of the pre-planarization by the system 202 is to provide the surface 200S of copper layer on the contour of the substrate, wherein the layer has the uniform thickness T above the contour, and the surface is scratched as described above. For purposes of illustration the thickness T may be in a vertical (or Z) direction of an orthogonal axis system that also includes X and Y axes. The wafer 200 after pre-planarization has a final configuration of the surface 200S (shown as an upper surface), and is ready for planarization using a standard CMP process with the above exemplary abrasive-free slurries which are formulated to remove copper and planarize the substrate 200, for example.

The substrate 200 is shown mounted on a table 210 that rotates the substrate around an axis, such as a vertical axis 206, which extends in the Z direction. With the substrate 200 mounted on the table 210, the surface 200S is generally horizontal (i.e., generally parallel to the X axis), and varies from true horizontal according to the shape of the contour. Preferably, the rate of rotation around the axis 206 may be in a range of from about 5 to about 200 RPM, and more preferably, the rate of rotation may be in a range of from about 10 to about 40 RPM, and most preferably, the rate of rotation may be in a range of from about 15 to about 25 RPM. Also, the table 210 is shown traversing the substrate 200 in the X direction, for example. Preferably, a rate of traverse may be in a range of from about 10 mm per minute to about 300 mm per minute, and more preferably, the rate of traverse may be in a range of from about 30 mm per minute to about 200 mm per minute. Most preferably, the rate of traverse may be in a range of from about 100 mm per minute to about 150 mm per minute. The table 210 may also maintain the surface 200S aligned in the Z direction with a reference line 212. It may be understood that with the substrate 200 mounted on the table 210 in this manner, the surface 200S faces upwardly and is exposed for pre-planarization.

FIG. 4 also shows the system 202 including a tool 214 for pre-planarizing the substrate 200. In a general sense, the tool may be configured with a shank 216 defining an axis of rotation 218. The shank is fabricated from a rigid material so that the axis of rotation is fixed. The axis 218 is shown in the exemplary orthogonal axis system as being horizontal, i.e., parallel to the X axis. The axis 218 is separated from the surface 200S by a distance 220, which may be referred to as the axis being spaced from the surface. For reference to other distances, a value of the distance 220 may be a first value. FIG. 4 also shows a drive 222 coupled to the shank 216 and holding the shank with the axis 218 horizontal. This coupling may be removable to facilitate replacing one tool 214 with another tool. The drive 222 may be a motor-controller type of unit in which input power may be accurately used to rotate the shank 216 at precise selected rates of rotation around the axis 218, as described below. This rotation is identified by an arrow 222R. These rates may be expressed in revolutions per minute (RPM) around the axis 218, and result in rotational (or angular) velocities of the tool 214. FIG. 4 shows a controller 224 providing a control signal 226 to the drive 222 to select a particular rate (RPM) of such rotation.

FIG. 4 further shows the controller 224 receiving a monitor signal 228 from a metrology unit 230 positioned above the tool 214, and thus also above the substrate 200. As described in more detail below, the metrology unit 230 may directly sense a pre-planarization condition of the exposed surface 200S of the substrate 200 to determine whether an endpoint of pre-planarization has been reached on the exposed surface. With the tool configuration as described below, and with the rotation of the tool on the axis of rotation 214, such sensing is not interfered with by the tool 214, such that the unit 230 may output the signal 228 as representing whether the desired uniform thickness T has been obtained over the entire underlying contour of the surface 200S. With respect to the pre-planarization process, for example, the desired uniform thickness T represents the endpoint, and thus obtaining the final configuration of the upper surface 200S resulting from the pre-planarization process.

FIG. 4 also illustrates the shank 216 coupled to a planarization member 232. The member 232 may, for example, be coupled to the shank 216 as by being integral, such as by being fabricated from the same blank of material from which the shank is also fabricated. In other embodiments of the tool 214, the member 232 may be a separate piece that is welded, adhered, or otherwise joined to the shank to affect the coupling. The planarization member 232 may be configured with a planarization surface 234. The planarization surface 234 is configured to be that part (or section) of the planarization member 232 that contacts the surface 200S for performing the pre-planarization process.

Figure 5A:
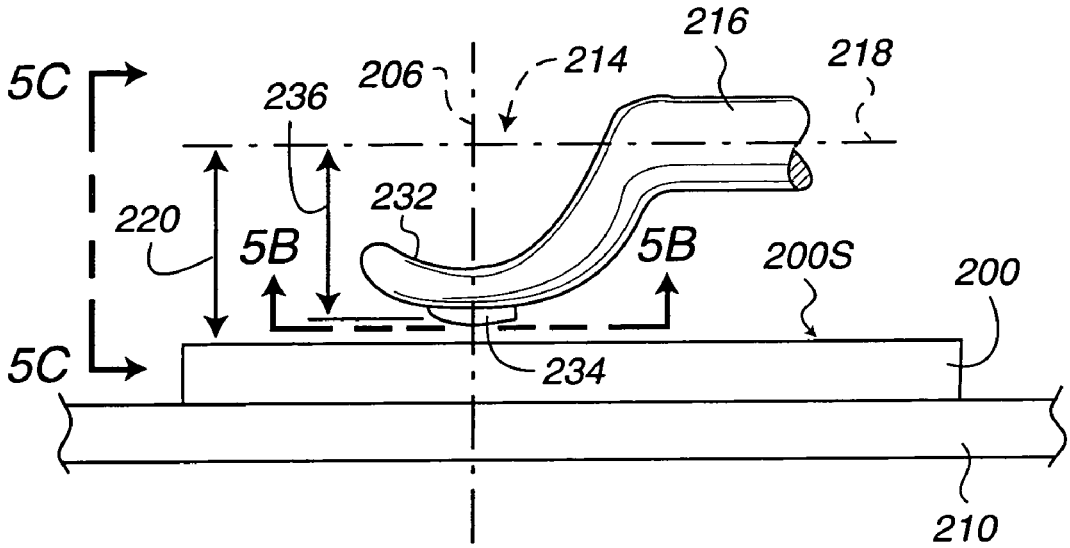
FIGS. 5A and 5B are enlarged schematic views of the tool, illustrating an at-rest-orientation of one embodiment of the present invention.
Figure 5B:
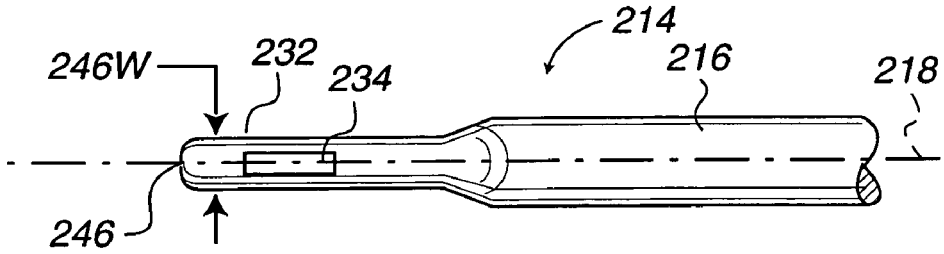
Figure 5C:
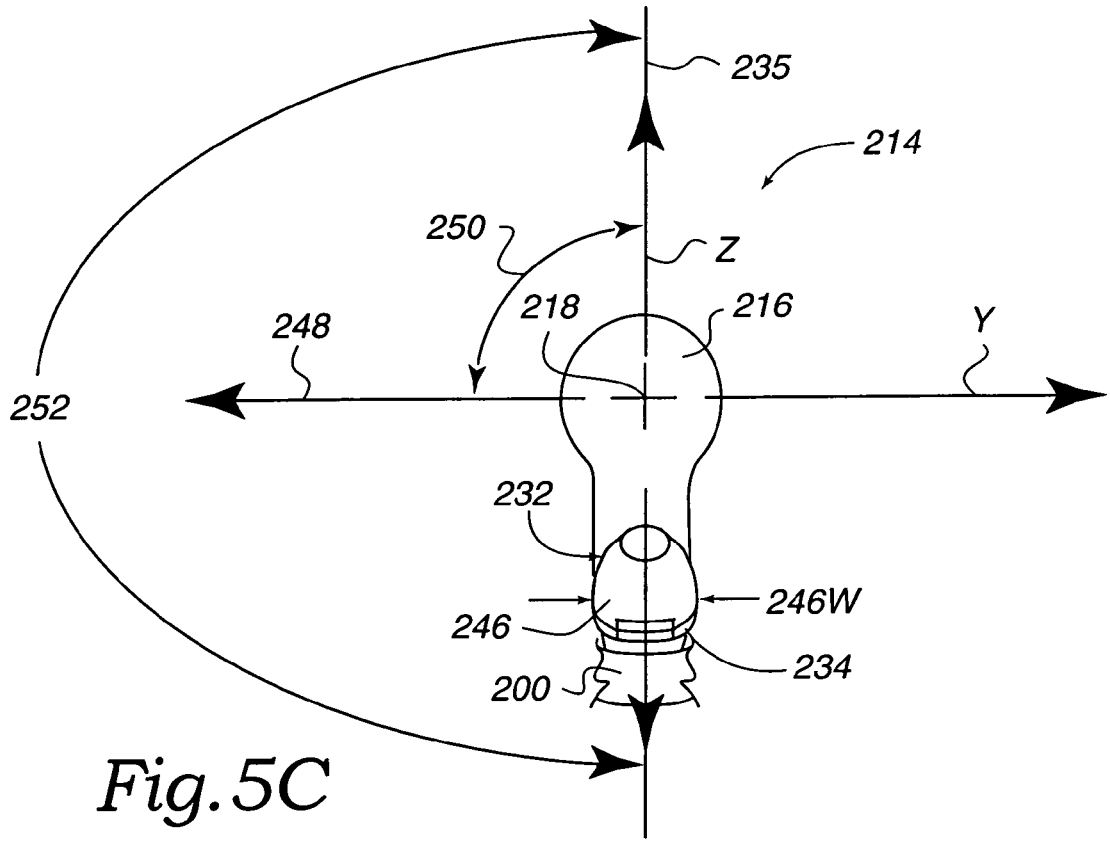
FIG. 5C illustrates a configuration of the planarization member including a section configured thin transversely of the axis of rotation, showing an embodiment of the tool of the present invention.

FIGS. 5A–5C are enlarged schematic views of the tool 214 shown in FIG. 4. The tool 214 is shown with the planarization member 232, and illustrate an at-rest-orientation, which occurs when the tool 214 is coupled to the drive 222, and the drive is off or in neutral, so that there is no rotation of the shank around the axis 218. FIG. 5A is an enlarged elevational view showing the tool 214 at rest with the planarization member 232 aligned with a vertical plane 235 (FIG. 5C) and the planarization surface 234 slightly above the surface 200S of the substrate 200. The planarization member 232 is configured so that the planarization surface 234 is spaced by an at-rest-distance 236 from the axis of rotation 218. The at-rest-distance 236 is measured radially from, and at a right angle with respect to, the axis 218 as viewed in FIG. 5A.

Figure 6A:
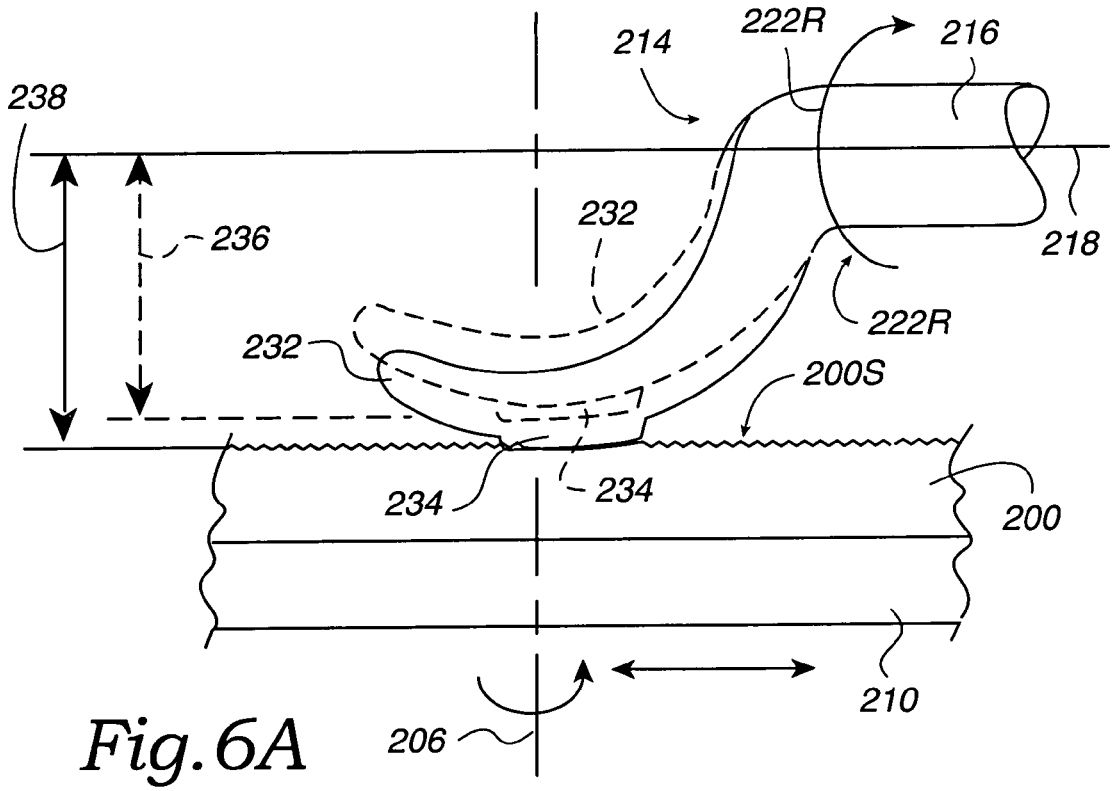
FIGS. 6A and 6B illustrate a rotational orientation of a shank around an axis of rotation of the tool of an embodiment of the present invention.
Figure 6B:
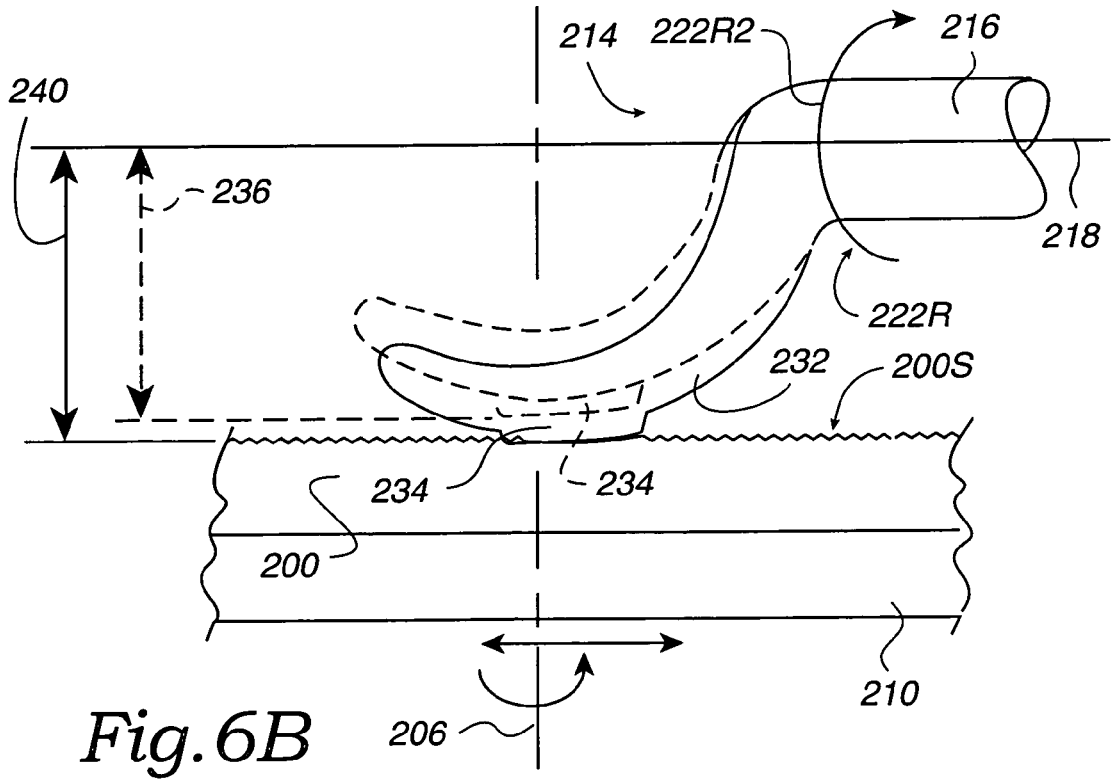

In contrast to the at-rest-orientation, FIGS. 6A and 6B illustrate a rotational orientation of the shank 216 around the axis 218, which occurs when the tool 214 is coupled to the drive 222, and the drive is on, such as operating under control of the controller 224. In the rotational orientation of the shank 216 during a pre-planarization process, there is continuous rotation 222R of the shank around the axis 218. In a general sense, the planarization member is configured so that during the rotational orientation of the shank the planarization member 232 rotates around the axis 218 and spaces the planarization surface 234 at a second (rotational) distance 238 from the axis 218. FIG. 6A, for example, shows that at an appropriate rate of rotation 222R1, a value of the second distance 238 is greater than a value of the rest-distance 236. FIG. 6B, for example, shows that at an appropriate greater rate of rotation 222R2, a value of a third (rotational) distance 240 is greater than the value of the at-rest-distance 236 and greater than the value of the second distance 238. Because both the vertical location of the axis 218 and the vertical location of the table 210 (and thus of the wafer 200) are fixed, the increase of the distance 238 with respect to the at-rest-distance 236, and the increase of the distance 240 with respect to the at-rest-distance 236, result in the planarization surface 234 cutting into successive places on the surface 200S to pre-planarize the substrate 200.

Figure 6C:
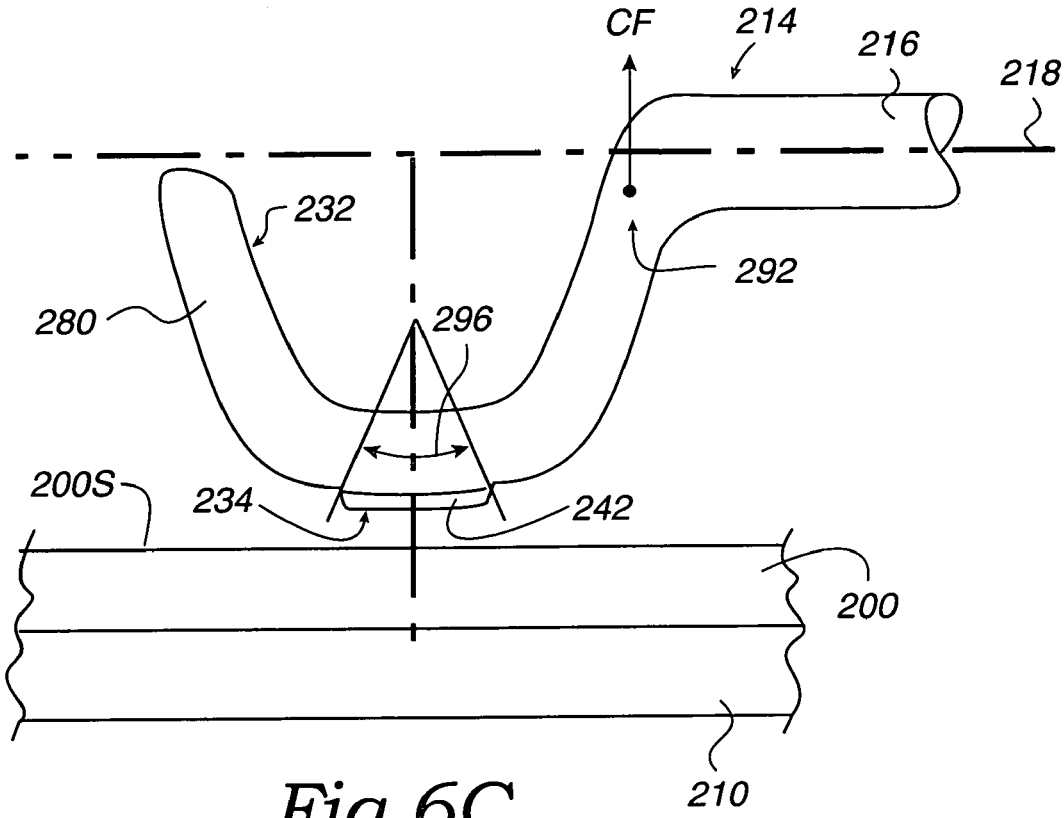
FIGS. 6C and 6D are elevational views of embodiments of the tool of the present invention, illustrating shapes of the planarization member and (FIG. 6D) an angle of tilt of the tool.

The tool 214 may be described as being configured with the planarization member 232, and in a more specific sense an embodiment of the member 232 may be configured with an arcuate-shaped planarization section (see 242, FIG. 6C). The arcuate-shaped planarization section 242 extends in a curved path generally radially from the shank 216 and carries the planarization surface 234. In another more specific sense, an embodiment of the planarization member 232 is configured with a characteristic of flexibility. This flexibility characteristic is flexibility in proportion to a velocity of rotation of the planarization member 232 around the axis 218. This characteristic enables the planarization member 232 to flex during the rotation 222R. In detail, the flex is relative to the axis of rotation 218, and is thus relative to the shank 216. With the flexibility characteristic, during the rotation 222R the planarization surface 234 becomes, and is, spaced at a distance greater than the at-rest-distance 236 from the axis of rotation 218. As illustrated in FIGS. 6A and 6B, such spacing at the greater distance may include (at an appropriate exemplary rate of rotation 222R2) the value of the third distance 240 being greater than the value of the rest-distance 236 and the value of the second distance 238, and (at an appropriate exemplary rate of rotation 222R1) the value of the second distance 238 being greater than the value of the rest-distance 236.

In another embodiment of the tool 214, the shank 216 may be fabricated from a rigid material, and the drive 222 may mount the shank 216 so that the axis of rotation is at the fixed vertical position with respect to the Z axis. The configuration of the planarization member may include fabricating the member 232 from a material having the above-described flexibility characteristic, defined for example by a modulus of elasticity (i.e., Young's modulus). The material may be selected so that the modulus of elasticity allows the planarization member to flex (or bend or deform) to provide a predetermined range of values. This range is exemplified by the second distance 238 and the third distance 240. The values in the range are in proportion to (i.e., in response to) a selected range of the velocity of rotation 222R of the planarization member 232 around the axis of rotation 218. For example, reference is again made to FIGS. 6A and 6B. Such predetermined range of values of distances (including a value of the exemplary second distance 238) is exemplified by such spacing at a distance greater than the at-rest-distance 236, the distance 238 corresponding to the exemplary velocity of rotation 222R1. This range includes the value of the exemplary third distance 240, shown greater than the value of the at-rest-distance 236 and greater than the value of the second distance 238. The distance 240 corresponds to the exemplary velocity of rotation 222R2, which is greater than the velocity of rotation 222R1.

In another embodiment of the tool 214, FIG. 5C illustrates that the configuration of the planarization member 232 may include a section 246 configured thin transversely of the axis 218 along the Y axis (line 248) extending at a first angle 250 around the axis 218. The first angle 250 is shown as about 90 degrees from vertical (Z axis). Also, to provide the above-described offset (or at-rest-distance 236), the thin section 246 extends generally transversely of the axis 218 along the Z axis (perpendicular to the line 248), and at a second angle 252 of 180 degrees around the axis 218, to locate the planarization surface 234 at the at-rest-distance 236 from the axis of rotation 218. The thin section 246 at this at-rest orientation supports the planarization surface 234 close to the surface 200S.

Figure 5D:
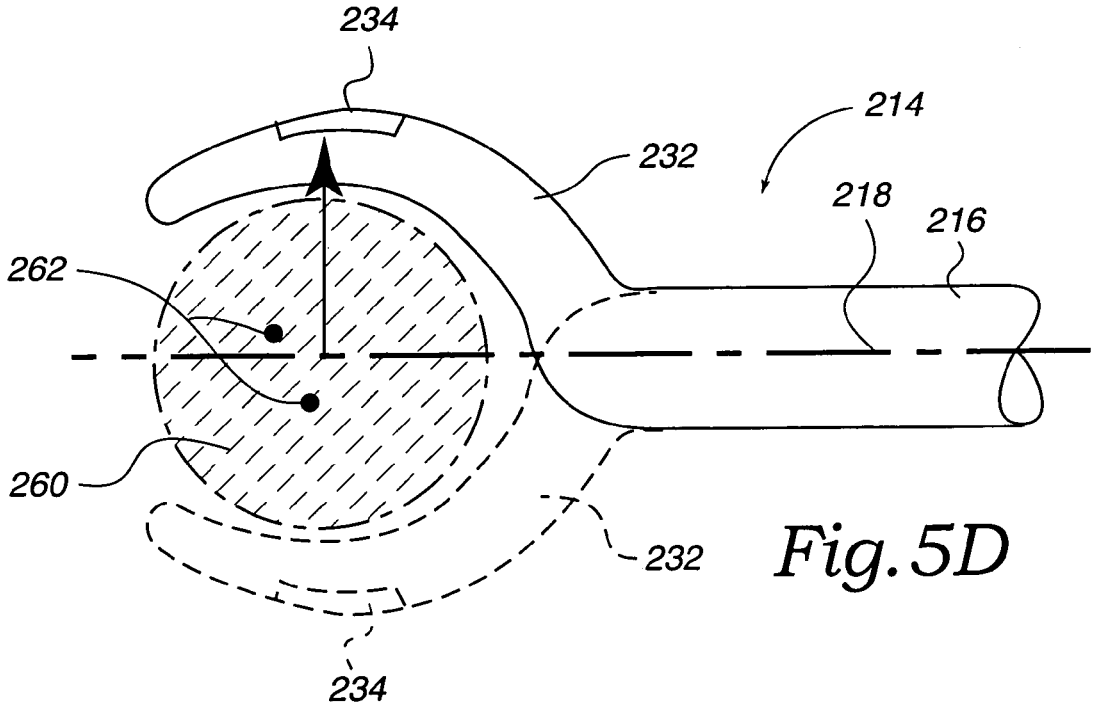
FIG. 5D shows the tool at-rest with the planarization member in a horizontal plane, illustrating an embodiment of the present invention.
Figure 8:
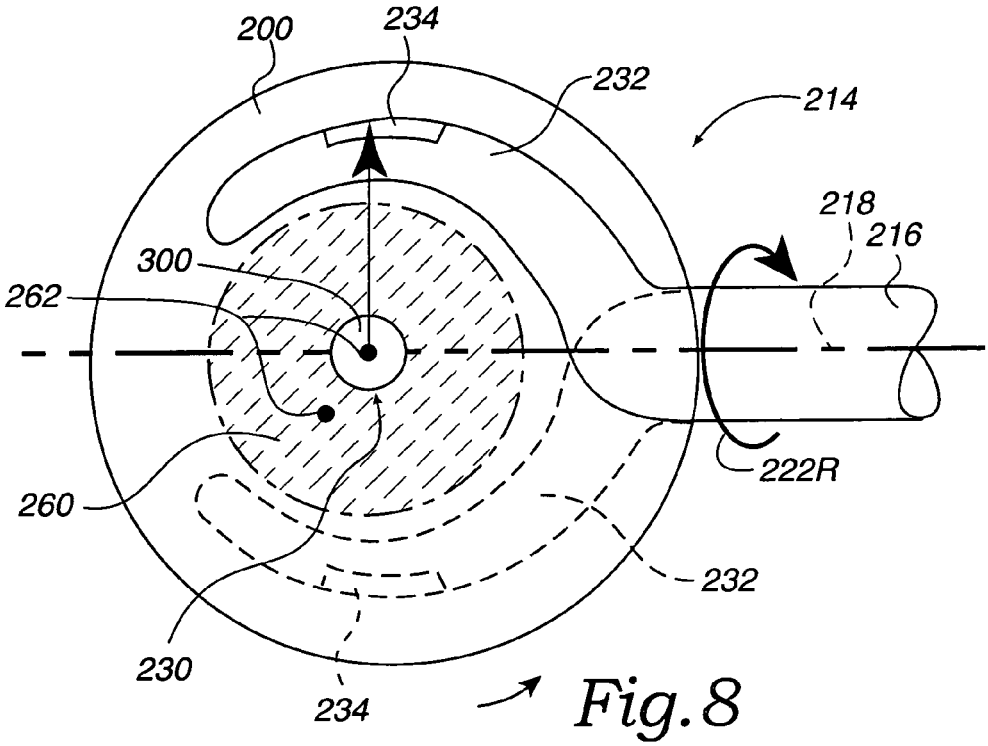
FIG. 8 is a schematic diagram illustrating a metrology unit configured with a sensor positioned to look downwardly through an open area during a clear view time period in accordance with one embodiment of the invention.

To illustrate another aspect of an embodiment of the tool 214, FIG. 5D shows the tool at-rest with the planarization member 232 in a horizontal plane. This plane is parallel to the surface 200S of the substrate 200. As thus shown in FIG. 5D, because of the offset configuration of the member 232 (with the planarization surface 234 at the at-rest-distance 236 from the axis), the member 232 defines an open area 260. The open area 260 is illustrated by a circle filled with dash lines. The open area is shown as a generally circular, for example, plane circumscribed by the curved-shape, or arcuate-shape, of the member 232. The open area 260 is shown circular because during the rotation of the tool 214 the planarization member 232 is also oriented 180 degrees opposite to that shown in solid lines in FIG. 5D, which opposite orientation is shown in dashed lines. It may be understood that, at any instant of time during the rotation of the planarization member 232 around the axis 218, because of the thinness and configured shape of the planarization member 232, only a portion of the open area 260 will (in plan view) be overlapped by the planarization member 232. Moreover, during most of the rotation of the planarization member 232 around the axis 218, the planarization member 232 is away from the vertical orientation shown in FIG. 5C. With the planarization member 232 away from the vertical orientation, there are generally vertical paths for observation or sight of, or a window for a metrology operation to observe, the location on the surface 200S of the wafer 200 last engaged (or contacted) by the planarization surface 234. These paths and window are collectively identified by the reference number 262 (FIGS. 5D and 8). In FIG. 4, these paths (or window) are shown as a line 262 and may be aligned with (parallel to) the Z axis or be inclined with respect to the Z axis according to specifications for use of the metrology unit 230. These paths and window 262 are not obstructed by the tool 214 most of the time during the rotation of the planarization member 232 around the axis 218. For descriptive purposes this time may be referred to as a period of time of unobstructed observation or sight of the location on the surface 200S of the wafer 200 at which the planarization surface 234 last-engaged the substrate 200. This time is also a period of time of a window for a metrology operation to observe the same location on the surface 200S of the wafer 200, and may be called a "clear view time period". This location on the surface 200S is thus a clearly-observed location, which is centered on the vertical axis Z, and the metrology unit 230 is configured to be effective during the clear view time period.

FIGS. 4 and 8 illustrate the metrology unit 230 as being configured with a sensor 300 positioned to "look" downwardly through the open area 260 during the clear view time period. The "look" is generally parallel to the Z axis, but may be at a generally small angle relative to the Z axis and still look through the open area 260. Moreover, the reaction time period in which the sensor is configured to make the determination described below is proportional to a duration of the clear view time period that corresponds to a particular rate of rotation 222R of the shank 216. For example, the drive 222 may provide a rate of rotation 222R in a range of from about 1000 to about 30000 RPM, and more preferably, in a range of from about 2000 to about 10000 RPM, and most preferably, in a range of from about 2000 to about 5000 RPM.

The sensor 300 may be an optical, sonic or eddy-current type of sensor, such as a sonic sensor provided by Rudolph. The type of sensor 300 may be selected according to the required response time, for example. Thus, the sensor 300 may have a response time corresponding to the clear view time period. During this response time, the sensor 300 may make one or more observations through the open area 260 and determines whether the endpoint of pre-planarization has been reached on the exposed surface 200S of the substrate 200. The output of the unit 230 includes the monitor signal 302 indicating the rate of rotation 222R at which the drive 222 should operate to properly and gradually remove the copper layer from over the contour of the surface 200S. The output of the unit 230 may also include in the signal 228 an indication whether the end point has been reached. Upon sensing the endpoint, the drive 222 stops because the layer is now of a uniform height over the contour of the surface 200S. The controller 224 is responsive to the signal 228 for controlling the drive 222 to regulate the velocity of rotation 222R of the planarization member 232 around the axis 218, including a zero velocity at the endpoint. The controller also adjusts the velocity of rotation 222R according to a depth to which it is desired to cut into, or scratch, the surface 200S for removal of the layer. This depth is achieved by varying the distances between the planarization surface 234 and the axis 218 as described above in respect to the exemplary distances 238 and 240 (FIG. 6B). For example, the depth variation may be in a range of from about 0.02 to about 1 micron, and more preferably, in a range of from about 0.03 to about 0.5 microns, and most preferably, in a range of from about 0.05 to about 0.2 microns. In review, the sensor 300 and the controller 224 operate in real-time during the grinding operation performed by the tool 214, and are effective to both adjust the Z axis position of the planarization surface 234 to follow the contour of the substrate 200, and to further adjust such Z axis position of the planarization surface 234 to render the thickness T of the exemplary copper uniform on top of such contour.

In more detail, during the pre-planarization, the table 210 mounts the substrate 200 for both the rotation and the traversing of the wafer relative to the tool 214. In this manner, as the substrate 200 rotates and traverses, the planarization section (e.g., 246 of the member 232) contacts successive locations across the copper topography. The velocity of rotation 222R of the planarization surface 234 around the axis 218 is used to control the deflection of the planarization section within the predetermined range of values (e.g., 238 and 240) so that the planarization section follows the contour of the substrate and removes portions of the exemplary copper layer to provide the pre-planarized substantially uniform layer thickness T above the contour.

In another embodiment, the tool 214 may include the planarization surface 234 configured for grinding, e.g., with material taken from the group consisting of diamonds, polishing pad material, silicon nitride, silicon carbide, CVD diamond coated materials, silicon, or any other material that is compatible with the interconnect process that is harder than copper. More preferably, in one embodiment of the tool 214 the planarization surface 234 is configured with industrial-grade diamonds, such as those marketed by TBW Corporation or 3M Corporation. These may have a size and shape suited for making the above-described scratches in the surface 200S. For example, a suitable diamond may have a shape characteristic in which the cutting facet is oriented appropriately and adhered to the end effector by a brazing technique or other methods know to those skilled in the art. The scratch depth is a function of the z-height control, diamond protrusion depths control and the radial velocity, i.e. with no Z-height variation, and slow radial speeds around the axis 218, minimal scratch depth can be achieved. If there is an exemplary 300 Angstrom variation in the Z-height during rotation of the end effector, scratch depth would be expected to be in the order of 300 Angstroms plus a factor related to diamond height. Diamond height variation does not directly translate into scratch depth variation (i.e., it depends on the radial velocity, which is how fast the wafer is traversed relative to the tool 214, i.e., tool-wafer movement from center to edge). Such embodiment may be used, for example, for pre-planarizating the initial surface 200S, in which the thickness T has a relatively large variation from the desired endpoint of uniform thickness T.

In situations in which there has been removal of the relatively large variations from the desired endpoint of uniform thickness T, the remaining scratches may be removed by use of an embodiment of the tool 214 in which the planarization surface 234 is a polishing pad. Such pads may be made from material such as polyurethane or a finer grit abrasive. The pad can be adhered by adhesive or by a combination of adhesive and capturing the pad using a beveled retainer.

Figures 9A, 9B, 9C:
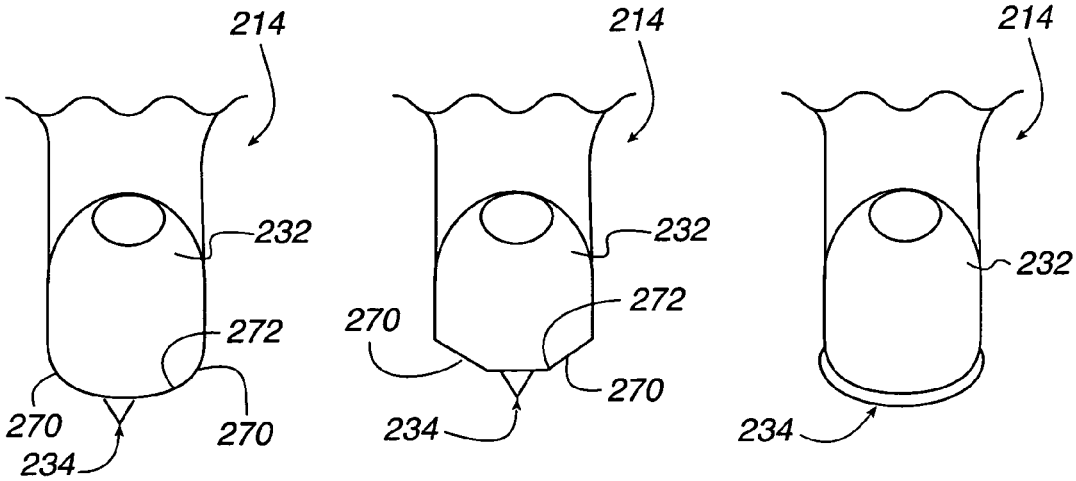
FIGS. 9A, 9B and 9C are schematic diagrams showing peripheral edges of the planarization surface rounded (FIG. 9A) or beveled (FIG. 9B) or in an exemplary diamond configuration (FIG. 9C) in accordance with embodiments of the invention.

Regardless of the type of planarization surface 234 used on the tool 214, to provide adequate support of the planarization surface 234 on the planarization member 232, the surface 234 (e.g., the diamond or pad) and not the member 232 should be the only point of contact between the tool 214 and the surface 200S of the substrate 200. Thus, as shown in FIGS. 9A, 9B and 9C, peripheral edges of the planarization surface 234 may be rounded (FIG. 9A) or beveled (FIG. 9B) and the illustrated exemplary diamond (or diamonds arranged in series or an array) centered between the rounded or beveled edges. In the case of the polishing pad, the pad may extend around the rounded edges. As rounded or beveled, the planarization surface 234 may be said to be configured with reliefs defining a promontory 272, and the promontory supports the diamonds or other material that forms the substrate-engaging surface 234.

Figure 6D:
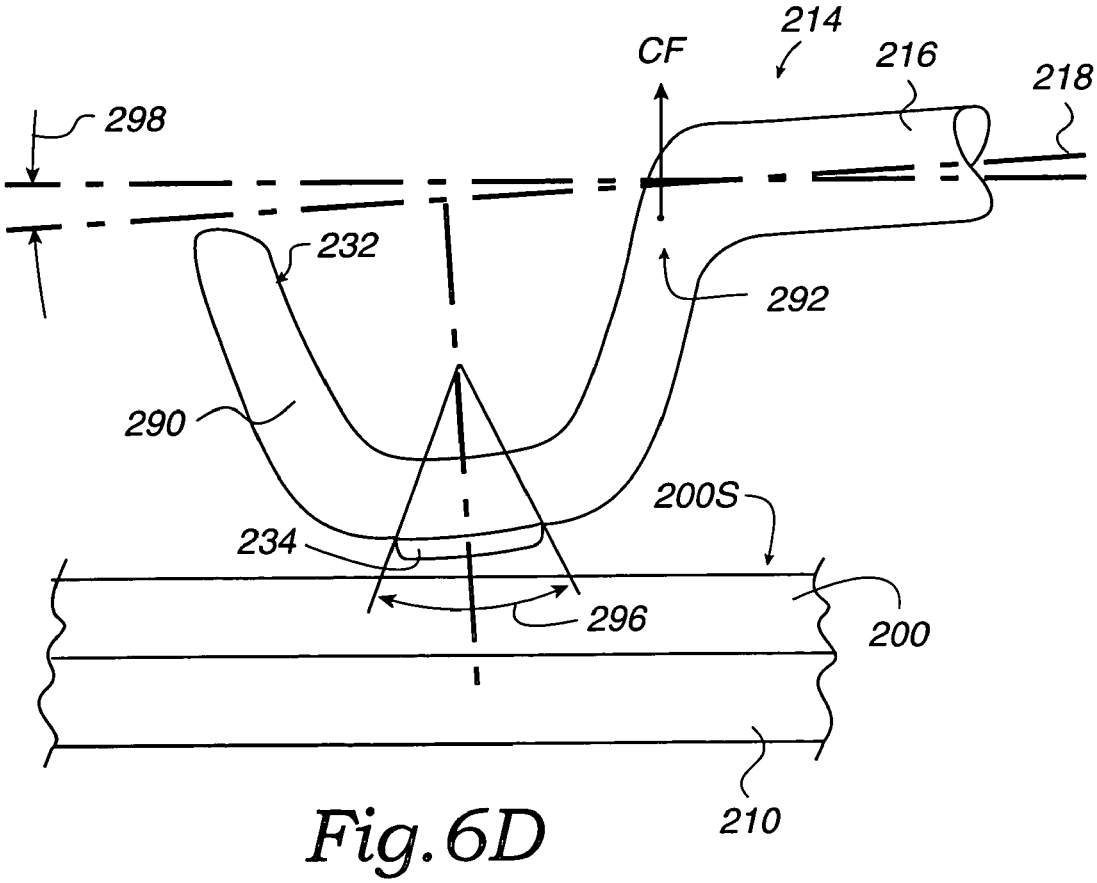

FIGS. 6C and 6D are elevational views of other embodiments of the tool 214 for pre-planarizing the substrate 200, in which the tool may comprise the shank 216 as described above, and another embodiment of the planarization member 232 coupled to the shank 216. Referring first to the above-described embodiments of the member 232, a generally hook-shaped configuration was observed. In the FIG. 6C embodiment of the planarization member 232, the generally hook-shaped configuration is more specifically defined as comprising a hook-shaped section 280. The hook-shaped section 280 is coupled to the shank 216 and is configured with a generally curved shape, shown in FIG. 6C as a semi-oval shape. Alternatively, in the FIG. 6D embodiment of the planarization member 232, the generally hook-shaped configuration is more specifically defined as comprising a hook-shaped section 290. The hook-shaped section 290 is coupled to the shank 216 and is configured with a generally curved shape, shown in FIG. 6D as a semi-elliptical shape. In each case of the section 280 and 290, the pre-planarization surface 234 may be mounted on the respective hook-shaped section 280 or 290 and is spaced by the at-rest-distance 236 (FIG. 5C) from the axis of rotation 218 during the depicted at-rest condition of the shank 216. The hook-shaped sections 280 and 290 are configured with the above-described flexibility defined by the above-described modulus of elasticity. Thus, upon rotation of the planarization member 232 around the axis 218 the respective hook-shaped section 280 or 290 flexes and moves the pre-planarization surface 234 to a plurality of rotation-distances (e.g., distances 238 and 240, FIG. 6B) from the axis 218. Such flexure may be described as being in response to the velocity of rotation 222R of the respective hook-shaped section 280 or 290 and around the axis 218 in a range of velocities. In another sense, the offset from the axis 218 of the rotating hook-shaped sections 280 and 290 results in a radially inward centripetal force CF that is proportional to the angular velocity of the rotating hook-shaped sections 280 and 290 and to the distance 238 or 240, for example, of those rotating hook-shaped sections 280 and 290 from the axis 218. The centripetal force CF acts on the respective section 280 or 290, and is opposite and equal to a centrifugal force FF acting radially outwardly on the planarization member 280 or 290. Because these forces are applied at axially-spaced locations, such as the force CF by the shank 216, and the force FF on the members 280 and 290, the above-described flexure may be described as being around a point 292 at which the shank 216 is coupled to the respective member 280 or 290. In a manner as described above, the modulus of elasticity of the member 280 and 290 allows the respective planarization member to flex (or bend or deform) to provide a predetermined range of values of the second distance 238, for example, in proportion to (i.e., in response to) a selected range of the velocity of rotation 222R of the planarization member 232 around the axis of rotation 218.

In a related embodiment of the members 280 and 290, the tool 214 is provided with the pre-planarization surface 234 configured with abrasive material extending radially beyond the hook-shaped member 232 away from the axis of rotation 218. Moreover, that material extends along a length 296 of the surface 234 shown in FIGS. 6C and 6D. The length 296 enables the surface 234 to remain in contact with the surface 200S during changes in the orientation of the axis 218 with respect to horizontal (X axis), as indicated in FIG. 6D by the angle 298. The drive 222 rotates the shank 216 with the axis 218 within a range of the angle 298, the range of angles being from about zero degrees to about 20 degrees. Upon a change in the angle 298 of the axis 218 within the range, and upon deflection of the planarization section 234 in response to the centripetal force CF, different parts of the length 296 of the planarization section 234 contact the surface 200S of the substrate for pre-planarization.

Figure 7A:
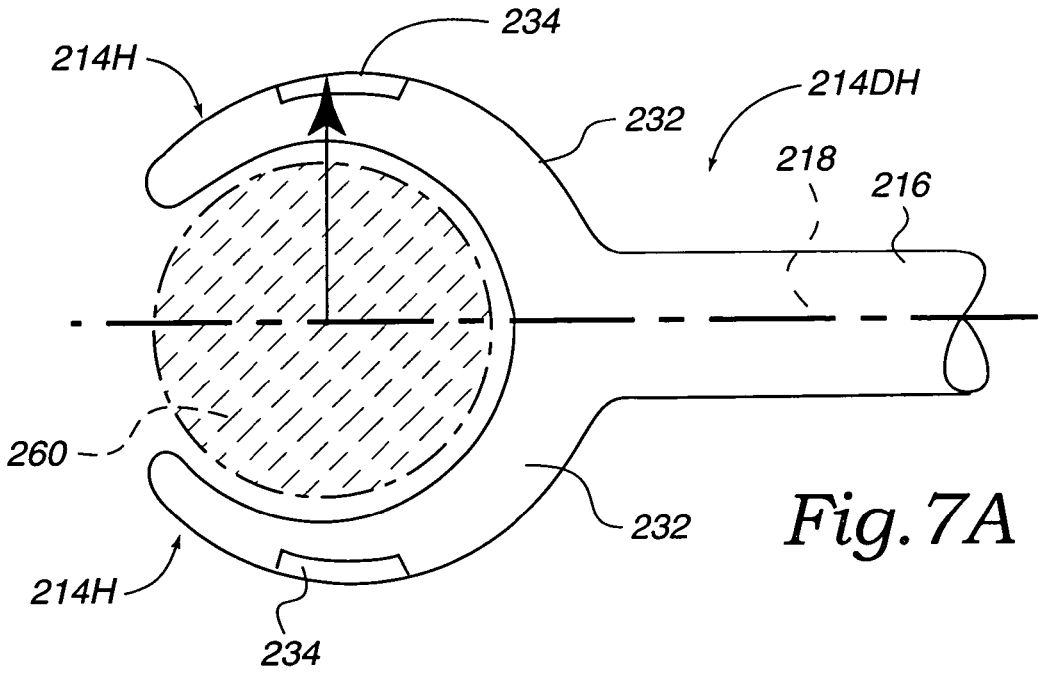
FIGS. 7A and 7B are elevational views of other embodiments of the tool of the present invention, illustrating additional shapes of the planarization member suitable for high speed rotation around the axis of rotation.

FIG. 7A shows a further embodiment of the tool 214 configured as a double-hook 214DH. Each single hook 214H may be similar to the structure of the planarization members 232 shown in FIGS. 6A–6D, for example. The opposed positions of the double-hooks 214DH of the double-hook structure 214DH, with one such planarization member 232 on each opposite side of the axis 218, provide a balance during rotation around the axis 218 at high-RPM-process conditions.

Figure 7B:
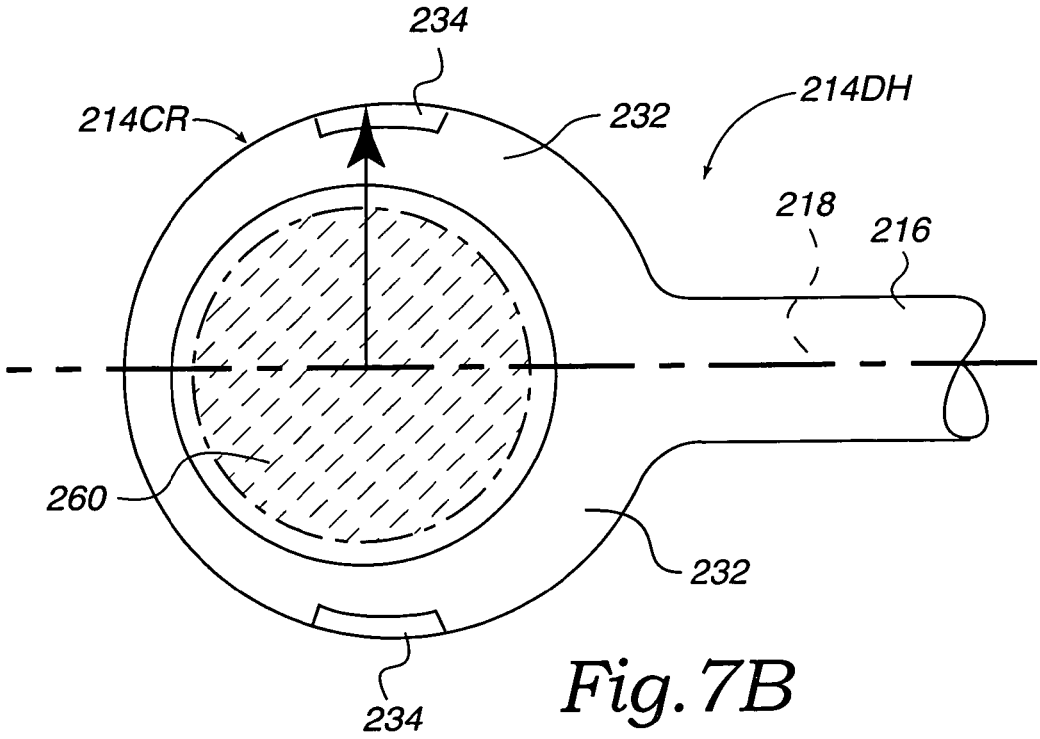

FIG. 7B shows a further embodiment of a double-hook 214DH. Here, a closed ring 214CR is provided, and may be a circular ring in the at-rest orientation. Each one half of the closed ring 214CR may be similar to the structure of the planarization members 232 shown in FIGS. 6A–6D, for example. The opposed half positions of the double-hook 214CR, with one such planarization member 232 on each opposite side of the axis 218, also provide a balance during rotation around the axis 218 at high-RPM-process conditions.

It may be understood that in each embodiment 214DH and 214CR, the mass of each planarization surface on the opposite sides of the axis 218, and of the member 232 adjacent to each of the surfaces 234, cause the respective double-hook configuration to flex outwardly, and such movement may be as shown in FIGS. 6A and 6B, for example, and as described in paragraphs 48 and 49, for example. The balance is indicated by each member 232 and surface 234 on one side of the axis 218 being at the same respective at-rest distance 236 at a particular time, or being at the same rotation-distance (e.g., 238 or 240) at the same time. Those same distances 236, 238, and 240 are on opposite sides of the axis 218. It may be understood then, that such balance may provide a similar response by each planarization member 232 to the forces resulting from the radial spacing of the planarization members 232 during the rotation. Thus, during the rotation of the plurality of the planarization members 232 the respective hook-shaped sections (or member 232 portions of the circular ring) flex the same to balance the planarization members 232 around the axis. Also, the open area 260 is defined by the double-hook 214DH and by the closed ring 214CR. As a result, these embodiments may operate in conjunction with the sensor 300 as described in paragraphs 53 and 54, for example.

FIG. 4 illustrates another embodiment of the system of the present invention that may pre-planarize the substrate 200. The system comprises the shank 216 that defines the axis of rotation 218. The drive 222 is provided for rotating the shank 216 with the axis of rotation 218 spaced by distance 220 from the substrate. The drive is configured to rotate the shank 218 at the velocity of rotation 222R around the axis 218. The planarization member 232 is rotated by the rotating shank 216 around the axis 218.

Figure 10:
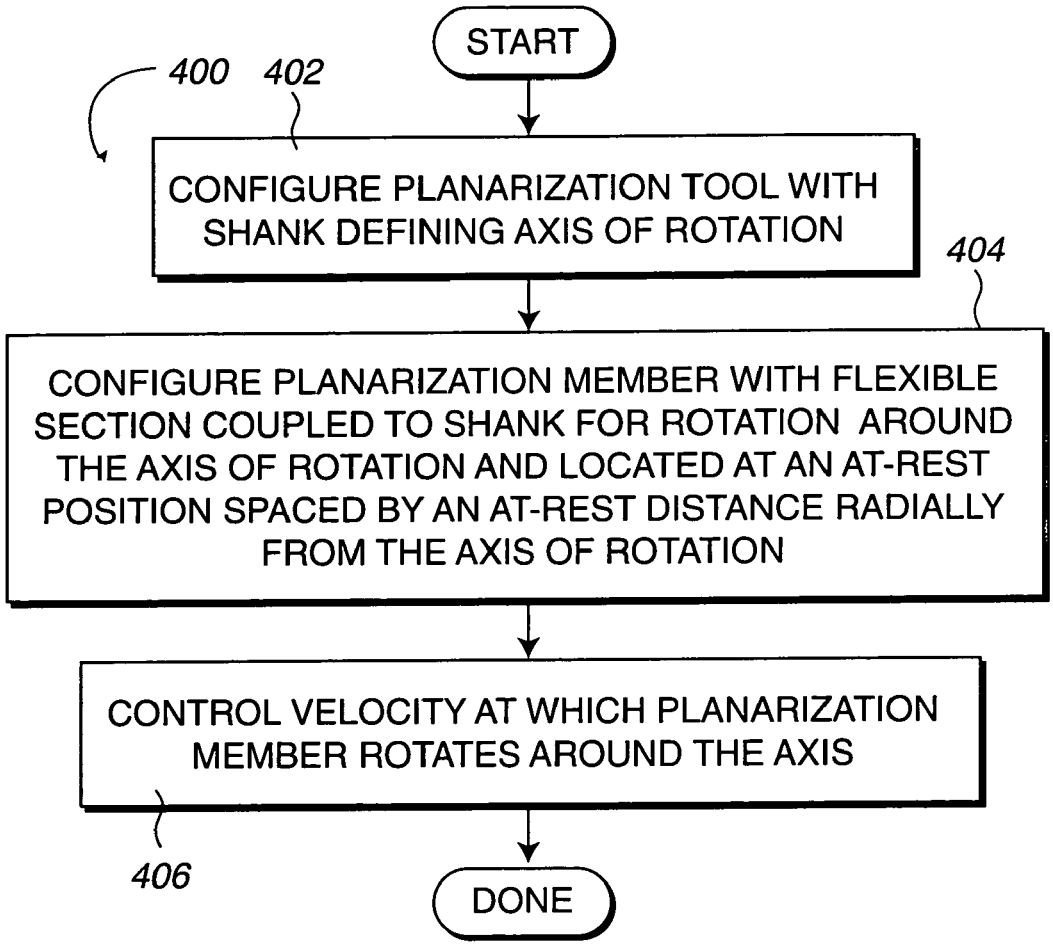
FIGS. 10 and 11 are flow chart diagrams illustrating method operations for performing a pre-planarization process in accordance with embodiments of the invention.

In another embodiment of the present invention, a method shown in FIG. 10 may be provided according to a flow chart 400 for pre-planarizing the substrate 200. The method starts and moves to an operation 402 of configuring a planarization tool with a shank defining an axis of rotation. The tool 214 may be provided in operation 402, for example so that an axis of rotation 218 is spaced from the substrate by a first radial space (or distance) having a first value 220. The method moves to an operation 404 of further configuring a planarization member with a section coupled to the shank for rotation around the axis of rotation and located at an at-rest-position spaced by an at-rest-distance radially from the axis of rotation. For example, the operation 404 may provide the planarization member 232 with a section 246 coupled to the shank 216 for rotation around the axis 218 and located at the at-rest-position (FIG. 5A) spaced by the at-rest-distance 236 radially from the axis 218. The configuring of the section 246 provides the flexure characteristic by which the planarization member 232 responds to the forces resulting from the radial spacing during the rotation 222R. As a result, during the rotation the section 246, for example, of the planarization member 232 flexes, and the planarization member becomes located at the rotation-position spaced at the rotation-distance (e.g., 238 or 240) radially from the axis 218. A value of the rotation-distance 238 or 240 is greater than a value of the at-rest-distance 236. The flexure characteristic is proportional to the velocity of revolution 222R at which the planarization member 232 rotates around the axis of rotation 218.

The method moves to an operation 406 of controlling the velocity of rotation 222R of the planarization member. The operation 406 may thus control the rate at which the member 232 rotates around the axis 218 to selectively position the member 232 within the space 220 between the tool 214 and the substrate 200 so that the planarization surface 234 engages the surface 200S to perform the pre-planarization operation on the substrate 200. The method is then done.

Other aspects of the operation 404 of the method of chart 400 may include the further configuring of the planarization member 232 to provide the flexure characteristic as a modulus of elasticity whereby changes in the velocity of rotation result in changes in the flexure.

Figure 11:
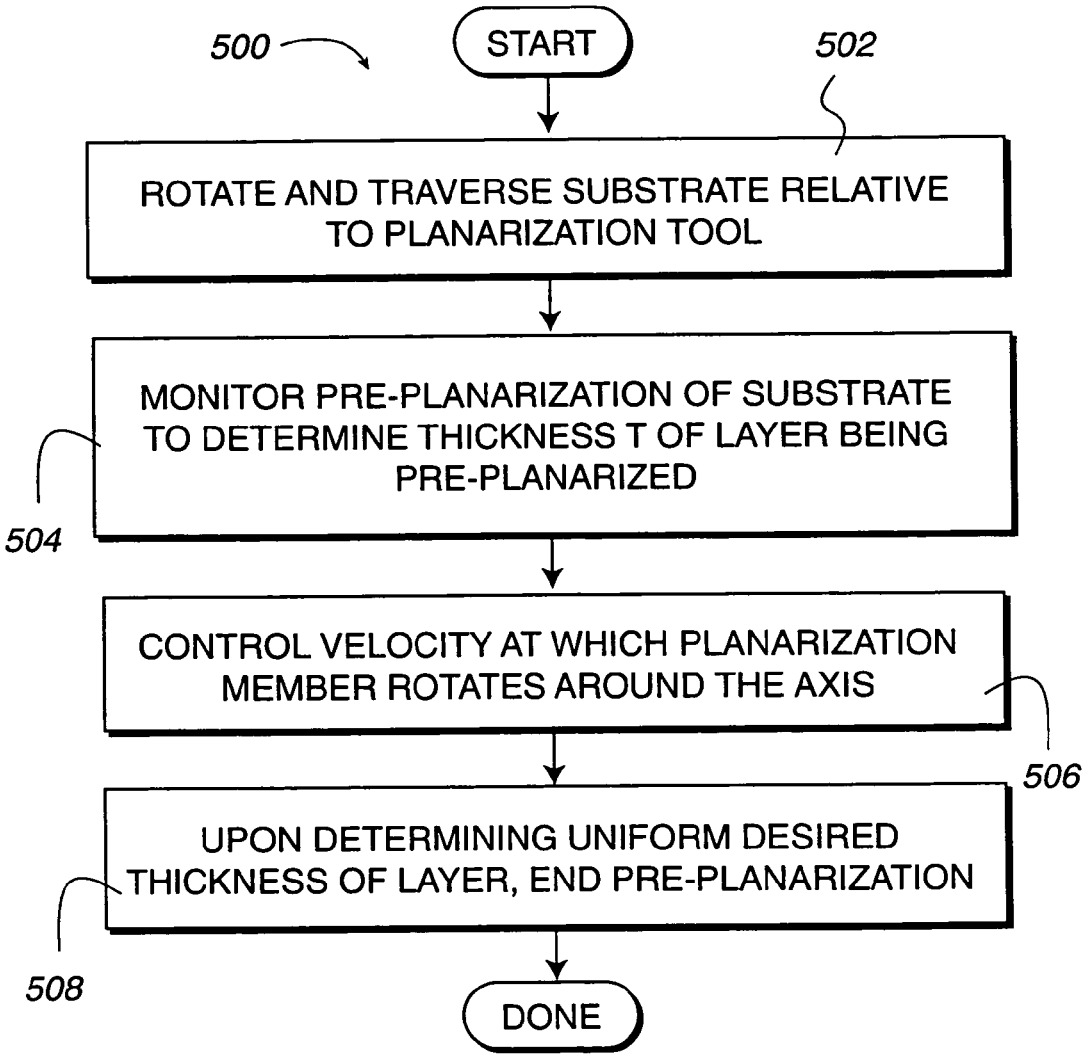

Other aspects of the method of chart 400 may include the substrate having a topography characterized by the wavy contour (FIG. 3A) from which the layer extends. The layer initially has the copper topography characterized by the irregular thickness T relative to the contour. FIG. 11 shows a method flow chart 500 to be performed after the method of flow chart 400. The method starts and moves to operation 502 of rotating and traversing the substrate 200 relative to the tool 214 so that as the substrate rotates and traverses the planarization surface 234 contacts successive locations of the copper topography. It is to be understood that during the rotation of the section 246, for example, around the axis 218 the surface 234 periodically (or intermittently) contacts the copper topography of the layer. Thus, during a period of time the rotating section and surface 234 are away from the substrate 200 and expose the layer. The method moves to operation 504 of monitoring the pre-planarization of the substrate to determine the thickness T of the copper topography of the layer at the exposed location of the layer last contacted by the planarization surface 234. The monitoring may be performed by the unit 230, and may provide the signal 228 to the controller 224.

In more detail, the controlling operation 406 may control the velocity of rotation 222R of the planarization section 232 around the axis of rotation 218 based on the height of the contour and the determined thickness T of the layer so that the deflection of the planarization section 232 within the predetermined range of values corresponds to the contour and is offset from the contour to remove portions of the layer to provide a substantially uniform layer thickness T above the contour as the substrate rotates and traverses.

Figure 1:
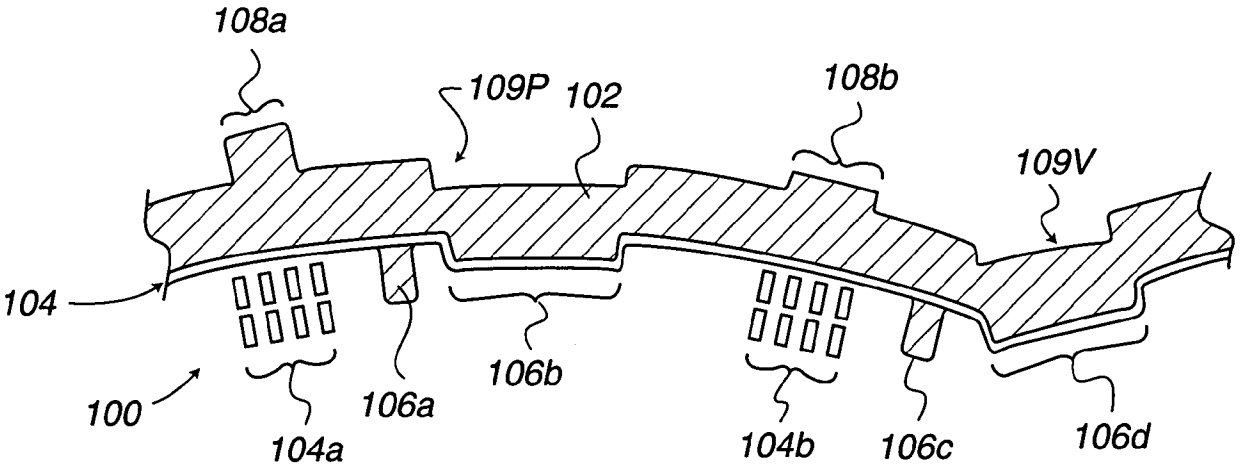
Fig. 1 (Prior Art)
FIG. 1 is a simplified schematic diagram illustrating a silicon substrate having a copper layer deposited thereon.

As a result of the normalization provided by the pre-planarization system 202 and methods described above, the desired planarization of the pre-planarized substrate 200 may now be standardized regardless of the type of incoming substrate. Thus, for example, it is conceivable that a single standardized CMP process for planarization of the substrates may be instituted regardless of the type of the incoming substrate. Additionally, the above-noted abrasive-free slurries available from Hitachi are exemplary slurries that may be used here. Thus, the above-described method and system 202 satisfy the needs for methods of and apparatus for normalizing the surface of a substrate to be planarized in order to more efficiently perform planarization processes. Further, by the control of the rotational velocity 222R of the drive, and thus of the tool 214, and thus of the effective depth of action of the planarization surface 234 on the surface 200S, these methods and system 202 provide the needed removal of the excess copper in regions 108*a* and 108*b* (FIG. 1) while following the contour of the substrate, to normalize the substrate surface 200S and provide the uniform thickness T of the copper regardless of the initial height changes of the contour of the surface 200S. With detection of the contour of the surface 200S, such as in situ using the metrology unit 230, for example, the methods and system 202 provide the needed normalizing that is independent of other properties of the incoming substrate to be processed, e.g., pattern density and circuit layout, such that there can be minimal or reduced changes in the consumables used for CMP processing after normalizing. The standard drives 222 may be lower-cost (as distinguished from custom and expensive Z axis motors, for example), and yet still operate at high resolution. Thus, an electrical input to the drive 222 accurately results in precise control of the velocity of revolution 222R at low drive unit cost. As a result, the system 202 and method provide a relatively low-cost way to provide highly accurate (in a nanometer range) Z motion of the tool 214 relative to the surface 200S of the substrate 200. Additionally, because of the open area 260 and the reasonable duration of the clear view time period, these system 202 and methods provide a way to directly sense the surface 200 and perform normalizing without interfering with viewing or other monitoring of the normalizing activity by the metrology unit 230.

One skilled in the art will appreciate that the above-described abrasive-free slurries are formulated to remove copper and planarize trenches. These abrasive-free slurries are highly selective due to a chemical change produced when the barrier is exposed during endpoint, in which a galvanic couple is formed between the copper and the tantalum. This results in inhibition of the copper polish process, i.e., the process becomes self-stopping. While these abrasive-free slurries have demonstrated superior dishing and erosion characteristics, their effectiveness has been limited with respect to conventional CMP processes. As mentioned above, the presence of a "puddle" of copper remaining in the array regions, i.e., the super-fill areas, limits the use of abrasive-free slurries. That is, the exposure of the barrier in the trench regions stops the removal process before all the copper is cleared. Thus, the process is rendered unusable for many layouts that have a moderate to high super-fill region thickness. By incorporating the embodiments described herein, i.e., the pre-planarization processing by the above present methods 400 and 500, and present system 202, the abrasive-free slurries may be used since the super-fill areas are substantially eliminated during the pre-planarization process.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims. In the claims, elements and/or steps do not imply any particular order of operation, unless explicitly stated in the claims.

What is claimed is:

1. A system for pre-planarizing a wafer, the system comprising:

a shank defining an axis of rotation;

a drive for rotating the shank with the axis of rotation spaced from the wafer;

a planarization member rotated by the rotating shank around the axis of rotation, the planarization member being configured with a planarization section offset from the axis, wherein the planarization section offset from the axis is configured with a hook-like shape so that during the rotation around the axis of rotation the planarization section intermittently contacts the surface of the wafer and so that during a period of time in which the planarization section is out of contact with the wafer the planarization section exposes the surface of the wafer, the section having a modulus of elasticity selected so that during the rotation the planarization section deflects in response to centripetal force, the deflection being at a value in proportion to a velocity of rotation of the planarization section around the axis of rotation, the value being a value at which the planarization section may contact the wafer that is spaced from the axis of rotation;

a metrology unit configured with a sensor effective during the period of time to directly view the exposed surface and determine whether an endpoint of pre-planarization has been reached on the exposed surface of the wafer; and a controller responsive to the metrology unit for controlling the drive to regulate the velocity of rotation of the planarization section around the axis of rotation.

2. A system as recited in claim 1, wherein:

the drive rotates the shank with the axis of rotation spaced from and within a range of angles with respect to a surface of the wafer to be pre-planarized, the range of angles being from about zero degrees to about 20 degrees; and upon a change in the angle of the axis of rotation within the range and upon deflection of the planarization section in response to the centripetal force, different parts of the planarization section contact the wafer for pre-planarizing the wafer.

3. A system as recited in claim 1, wherein:

the drive is configured to rotate the shank at the velocity of rotation around the axis of rotation, the velocity of rotation being in a range of velocities; and the modulus of elasticity is selected so that during the rotation the planarization section deflects in response to centripetal force, the deflection being within a predetermined range of the values in proportion to the velocity within the range of the velocity of rotation of the planarization section around the axis of rotation, the predetermined range of values including a plurality of values at which the planarization section may contact the wafer that is spaced from the axis of rotation.

4. A system as recited in claim 1, wherein the regulation of the velocity of rotation of the planarization section around the axis of rotation controls the deflection of the planarization section within the predetermined range of values so that the planarization section contacts the wafer to perform pre-planarization of the wafer.

5. A system as recited in claim 1, wherein the wafer has a wavy topography characterized by a contour from which a layer extends, the layer having an irregular thickness relative to the contour, the system further comprising:

a mount for rotating and traversing the wafer relative to the tool so that as the wafer rotates and traverses the planarization section contacts successive locations of the contour of the wafer; and wherein the velocity of rotation of the planarization section around the axis of rotation controls the deflection of the planarization section within the predetermined range of values so that the planarization section follows the contour and removes portions of the layer to provide a pre-planarized substantially uniform layer thickness above the contour.

6. A method of pre-planarizing a wafer, the method comprising the operations of:

configuring a planarization tool with a shank defining an axis of rotation, the axis of rotation being spaced from the wafer by a first radial space having a first value;

further configuring at least one planarization member with a section coupled to the shank for rotation around the axis of rotation and located at an at-rest-position spaced by an at-rest-distance radially from the axis of rotation, the at-rest-distance having a second value, the configuring of the section providing a flexure characteristic by which the at least one planarization member responds to forces resulting from the radial spacing during the rotation such that during the rotation the section flexes and the at least one planarization member becomes located at a rotation-position spaced at a rotation-distance radially from the axis of rotation, a value of the rotation-distance being greater than a value of the at-rest-distance, the flexure characteristic being proportional to a velocity at which the at least one planarization member rotates around the axis of rotation; and controlling the velocity at which the at least one planarization member rotates around the axis of rotation to selectively position the at least one planarization member within the space between the tool and the wafer so that the planarization surface of the at least one planarization member engages the wafer to perform a pre-planarization operation on the wafer.

7. A method as recited in claim 6, wherein the further configuring of the at least one planarization member provides the flexure characteristic as a modulus of elasticity whereby changes in the velocity of rotation result in changes in the flexure.

8. A method as recited in claim 6, wherein the wafer has a topography characterized by a wavy contour from which a layer extends, the layer initially having an irregular thickness relative to the contour, the method further comprising the operation of:

rotating and traversing the wafer relative to the tool so that as the wafer rotates and traverses the planarization surface contacts successive locations of the contoured topography of the wafer.

9. A method as recited in claim 6, wherein:

during the rotation of the section around the axis of rotation the section periodically contacts the layer so that during a period of time the rotating section is away from the wafer and exposes the layer; and monitoring the pre-planarization of the wafer to determine the thickness of the layer at an exposed location of the layer last contacted by the section.

10. A method as recited in claim 6, wherein:

the controlling operation controls the velocity of rotation of the planarization section around the axis of rotation based on the height of the contour and the determined thickness of the layer so that the deflection of the planarization section within the predetermined range of values corresponds to the contour and is offset from the contour to remove portions of the layer to provide a substantially uniform layer thickness above the contour as the wafer traverses.

11. A method as recited in claim 6, wherein:

the further configuring of the at least one planarization member with a section coupled to the shank for rotation around the axis of rotation comprises configuring a plurality of the at least one planarization members on opposite sides of the axis, the configuring of the plurality of planarization members providing a similar response to the forces resulting from the radial spacing during the rotation such that during the rotation of the plurality of the planarization members the respective sections flex the same to balance the plurality of planarization members around the axis.

* * * * *